United States Patent [19]

Hyodo

[11] 3,988,556

[45] Oct. 26, 1976

[54] SWITCHING APPARATUS

[75] Inventor: Masayoshi Hyodo, Aichi, Japan

[73] Assignee: Kabushiki Kaisha Tokai Rika Denki Seisakusho, Aichi, Japan

[22] Filed: June 19, 1974

[21] Appl. No.: 480,801

[30] Foreign Application Priority Data

June 21, 1973 Japan ..... 48-73867
June 21, 1973 Japan ..... 48-73868

[52] U.S. Cl. ..... 200/264; 200/6 A
[51] Int. Cl.[2] ..... H01H 1/02
[58] Field of Search ..... 200/264, 159 B, 159 A, 200/6 A; 338/100, 114, 118, 2

[56] References Cited

UNITED STATES PATENTS

| | | | |
|---|---|---|---|
| 3,005,055 | 10/1961 | Mattke | 200/6 A X |
| 3,749,872 | 7/1973 | Foster | 200/159 A X |
| 3,806,471 | 4/1974 | Mitchell | 338/99 X |
| 3,873,795 | 3/1975 | Leighton et al. | 200/153 LA |

*Primary Examiner*—Herman J. Hohauser
*Attorney, Agent, or Firm*—Pollock, Vande Sande & Priddy

[57] ABSTRACT

An on-off switch comprising a contact element of conductive elastomeric material for establishing a current path between a plurality of terminals, and an actuating member for imparting a compressing force to the contact element. When the actuating member is manipulated to compress the contact element, the contact element is rendered electrically conductive to electrically connect the terminals with each other thereby turning on the switch.

5 Claims, 15 Drawing Figures

SWITCHING APPARATUS

BACKGROUND OF THE INVENTION

This invention relates to improvements in switching apparatus, and more particularly to improvements in a switching apparatus of the kind which selectively opens and closes an electrical circuit.

The switching apparatus of the present invention is a switch of the type which turns on and off an electrical connection between two or more terminals by an actuating member which is mechanically manipulated. A variety of switches of such a type are commonly known. In a conventional switch structure of this type, a movable member acts as a moving contact, and the switch is placed in the on position when the moving contact is brought into contact with the terminals, while the switch is placed in the off position when the moving contact is moved away from the terminals. This switch structure has not been suitable for applications in which the frequency of on-off manipulation is quite high. That is, this switch structure has been defective in that the service life of the switch is relatively short for the reasons that permanent deformation due to fatigue occurs in the moving contact during repeated use and that an arc jumps across the moving contact and the terminals when the switch is turned off. Another serious defect of the conventional switch structure has been the fact that the switching action cannot be reliably attained when the moving contact is mounted in an incorrect position during assembly. This fact has also demanded machining and assembling of high precision for the switching apparatus.

SUMMARY OF THE INVENTION

It is a primary object of the present invention to provide a switching apparatus in which the on-off operation between terminals is attained by a contact element of conductive elastomeric material.

Another object of the present invention is to provide a switching apparatus which comprises a contact element of conductive elastomeric material, and a manual actuating member adapted for making swinging movement for imparting a compressing force to the contact element.

In accordance with the present invention, there is provided a switching apparatus comprising a switch casing, as insulating holder fixed to said switch casing and having a plurality of terminals fixedly disposed therein, at least one contact element of conductive elastomeric material disposed to be engageable with anyone of said terminals, and actuating means swingably disposed within said switch casing so as to impart a compressing force to said contact element thereby rendering said contact element electrically conductive. The contact element is made by dispersing fine particles of conductive metal in a mass of non-conductive elastomer such as porous or non-porous silicone rubber, and opening and closing of the switch is controlled by merely compressing the contact element by the actuating means or releasing the force imparted to the contact element by the actuating means. Thus, the switching apparatus according to the present invention is entirely different from the prior art switch of this kind in which the moving contact of metal is brought into contact with the terminals to turn on the switch. The switching apparatus according to the present invention is advantageous in that it has an extended service life since it is entirely free from damage or trouble due to generation of frictional heat and spark at the elctrode surface or contact surface.

DESCRIPTION OF THE PREFERRED EMBODIMENTS

Figure 1:
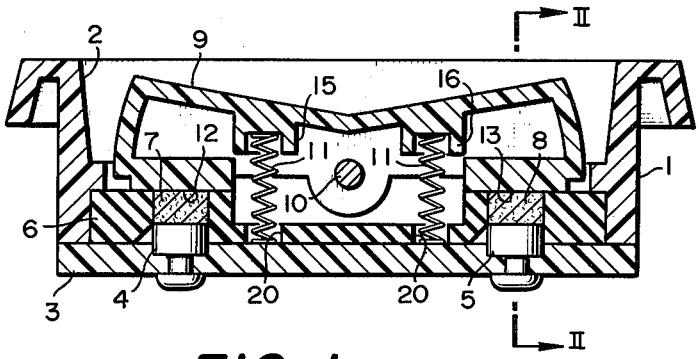
FIG. 1 is a vertical sectional, front elevational view of a first embodiment of the present invention in the off position.
Figure 2:
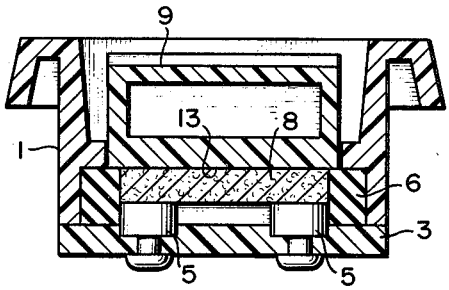
FIG. 2 is a section taken on the line II — II in FIG. 1.
Figure 3:
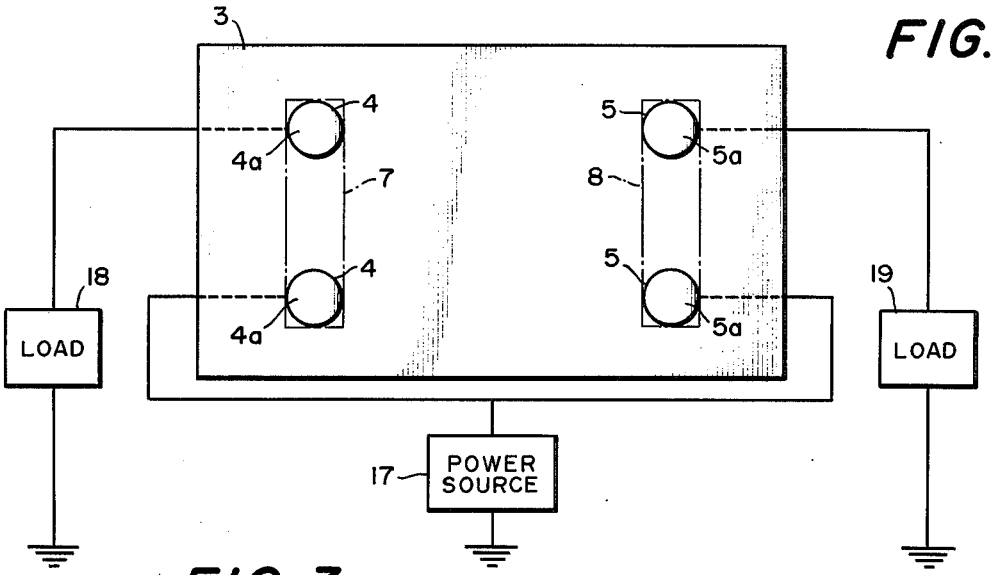
FIG. 3 is a plan view of parts of FIG. 1 to show an arrangement of terminals connected to external circuits.
Figure 4:
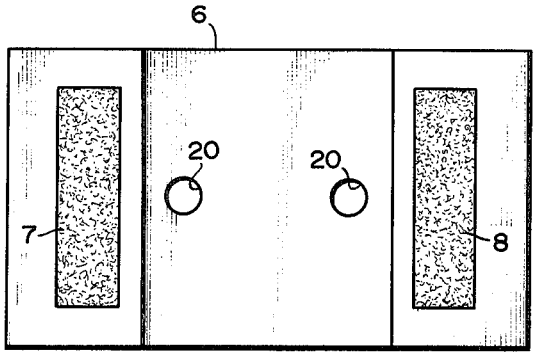
FIG. 4 is a plan view showing the relation; between an elastic mat and contact elements used in the first embodiment.

FIGS. 1, 2, 3 and 4 show a first embodiment of the present invention. Referring to FIGS. 1 and 2, a switch casing 1 has a wide opening 2, and a holder 3 of electrical insulator is fixed to the bottom of the switch casing 1. Two pairs of terminals 4, 4 and 5, 5 are held in the insulating holder 3 on opposite sides of the transverse centerline of the insulating holder 3 and have their electrode surfaces *4a*, *4a* and *5a*, *5a* exposed in the switch casing 1. An electrically insulating elastic mat 6 of material such as sponge rubber is superposed on the insulating holder 3 to serve as a supporting member for a pair of contact elements 7 and 8 of conductive elastomeric material. These contact elements 7 and 8 are fixedly supported in the elastic mat 6 at positions opposite to the electrode surfaces *4a*, *4a* and *5a*, *5a* of the respective electrode pairs as shown in FIG. 3. These contact elements 7 and 8 are made by dispersing fine particles of conductive metal in a mass of non-conductive elastomer such as porous or non-porous silicone rubber so that they are non-conductive in a non-compressed state, but are rendered electrically conductive when a pressure is imparted to compress the elastomer and the fine metal particles are brought into contact with one another.

A seesaw-like swinging knob 9 is swingably supported by a pivot 10 in the wide opening 2 of the switch casing 1 so that it can make swinging movement around the axis of the pivot 10 which extends along the transverse centerline of the insulating holder 3. A pair of pressure imparting portions 12 and 13 are provided at the opposite ends of the swinging knob 9 opposite to the respective contact elements 7 and 8. A pair of compression springs 11 are interposed between the insulating holder 3 and a pair of spring bearing portions 15 and 16 formed on the swinging knob 9. The insulating elastic mat 6 serving as the contact element supporting member is shown in detail in FIG. 4 in which it will be seen that the compression springs 11 are received at one end thereof in respective perforations 20 bored in the mat 6.

When no actuating force is imparted to the swinging knob 9, the swinging knob 9 is maintained in a neutral position by the springs 11, and the pressure imparting portions 12 and 13 of the swinging knob 9 are in light contact with the associated contact elements 7 and 8. Therefore, these contact elements 7 and 8 are in a non-compressed state. In such a state, the contnact elements 7 and 8 are non-conductive, and current from a power source 17 cannot be supplied to anyone of loads 18 and 19 due to the fact that the switch is in the off position.

When an actuating force is imparted to the swinging knob 9 to cause swinging movement of the knob 9 in one direction, one of the pressure imparting portions 12 and 13 of the knob 9 imparts a compressing force to the corresponding contact element 7 or 8 to render the specific contact element 7 or 8 electrically conductive. The contact element 7 or 8 rendered electrically conductive establishes electrical connection between the electrode surfaces 4*a*, 4*a* or 5*a*, 5*a* of the terminals 4, 4 or 5, 5 to turn on the switch. The switch in the on position is restored to the off position shown in FIG. 1 by the force of the springs 11 as soon as the actuating force imparted to the swinging knob 9 is released.

Figure 5:
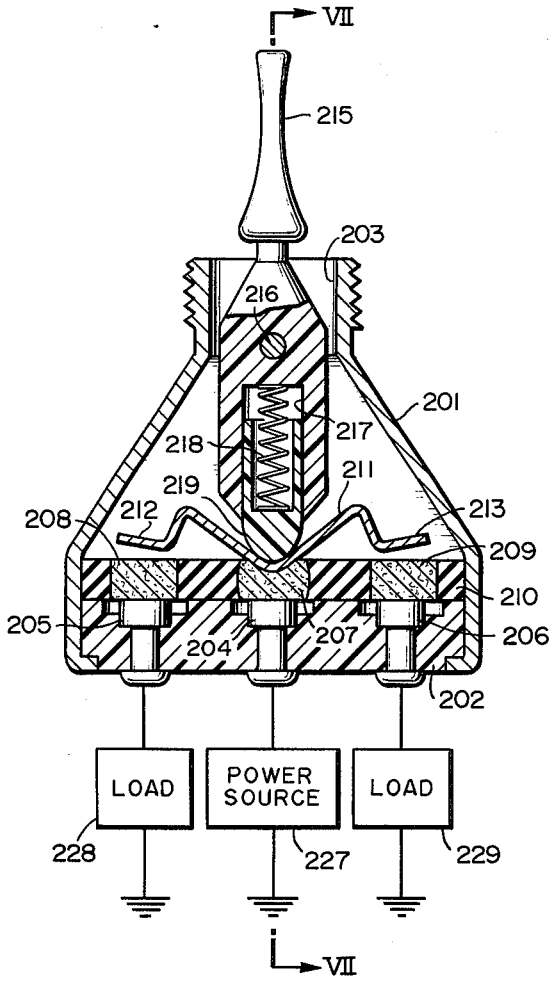
FIG. 5 is a vertical sectional, front elevational view of a second embodiment of the present invention in the off position.
Figure 6:
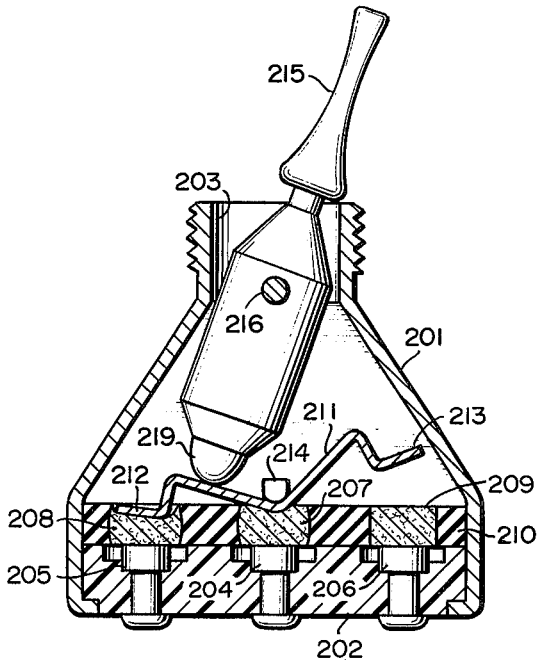
FIG. 6 is a view similar to FIG. 5 but showing the switch in the on position.
Figure 7:
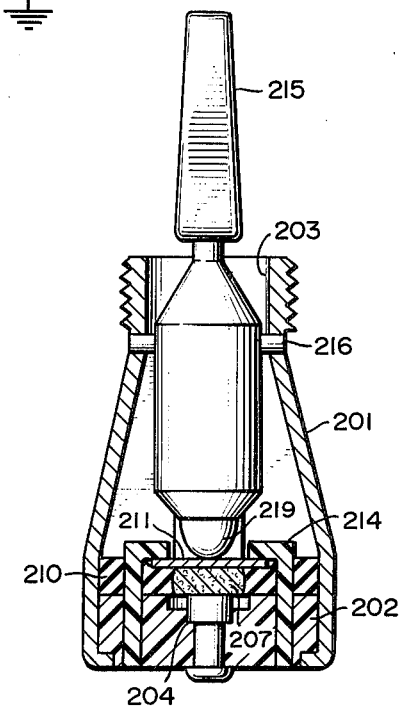
FIG. 7 is a section taken on the line VII — VII in FIG. 5.

FIGS. 5, 6 and 7 show a second embodiment of the present invention. Referring to FIGS. 5 to 7, a holder 202 of electrical insulator is fixed to the bottom of a switch casing 201 having an opening 203. A terminal 204 connected to a power source 227 is disposed in a central portion of the insulating holder 202, and a pair of terminals connected to respective loads 228 and 229 are disposed on opposite sides of the terminal 204 in the insulating holder 202. A plurality of contact elements 207, 208 and 209 of conductive elastomeric material are fixedly supported in a supporting member 210 which may be an electrically insulating elastic mat of sponge rubber having a thickness substantially equal to that of the contact elements 207, 208 and 209. This elastic mat 210 is superposed on the insulating holder 202 so that the contact elements 207, 208 and 209 can be disposed opposite to the respective terminals 204, 205 and 206. A swinging contact 211 is pressed at a V-shaped central portion thereof against the central contact element 207 by a fixture 214 fixed to the insulating holder 202 as best shown in FIG. 7. Thus, the contact element 207 is maintained always in an electrically conductive state. The swinging contact 211 is formed with a pair of pressure imparting portions 212 and 213 at opposite ends thereof opposite to the respective contact elements 208 and 209.

A swinging knob 215 extends into the switch casing 201 through the opening 203 of the switch casing 201 and is swingably supported by a pivot 216. This swinging knob 215 cooperates with the swinging contact 211 to constitute an actuating means. A bore 217 extends from the lower end of the swinging knob 215 to terminate at a position beneath the pivot 216 to receive therein a coil spring 218 and a contactor 219. The contactor 219 is urged downward by the spring 218 to be pressed against the central portion of the swinging contact 211 to be normally maintained in such a position. The contact elements 207, 208 and 209 are made by dispersing fine particles of conductive metal in a mass of elastomer such as porous or non-porous silicone rubber so that they are non-conductive in a non-compressed state, but are rendered electrically conductive when a pressure is imparted to compress the elastomer as shown in FIG. 6 and the fine metal particles are brought into contact with one another.

In the second embodiment, the central contact element 207 overlying the terminal 204 is always maintained electrically conductive by being compressed by the V-shaped central portion of the swinging contact 211. When no actuating force is imparted to the swinging knob 215, the swinging knob 215 is in a position in which the contactor 219 engages the V-shaped central portion of the swinging contact 211, and the pressure imparting portions 212 and 213 of the swinging contact 211 are spaced from the associated contact elements 208 and 209 to maintain these contact elements 208 and 209 in a non-compressed state. In such a state, therefore, current from the power source 227 is not supplied to anyone of the loads 228 and 229 due to the fact that the switch is in the off position.

When the swinging knob 215 is then caused to swing in one direction, for example, in a direction as shown in FIG. 6, the swinging contact 211 is urged by the contactor 219 to a position as shown, and the pressure imparting portion 212 engages and imparts a compressing force to the contact element 208 to render this contact element 208 electrically conductive. Thus, the contact element 208 cooperates with the swinging contact 211 to establish electrical connection between the terminals 204 and 205 thereby turning on the switch. It is apparent that the terminal 204 is electrically connected to the terminal 206 when the swinging knob 215 is swung in the other direction to compress the contact element 209 by the pressure imparting portion 213 of the swinging contact 211.

FIGS. 8, 9, 10, 11, 12, 13, 14 and 15 show some embodiments which are slight modifications of the second embodiment of the present invention. In these embodiments, an actuating means is capable of making swinging movement in a plurality of directions within a switch casing so as to establish electrical connection between a plurality of different terminals depending on the direction of swinging movement.

Figure 8:
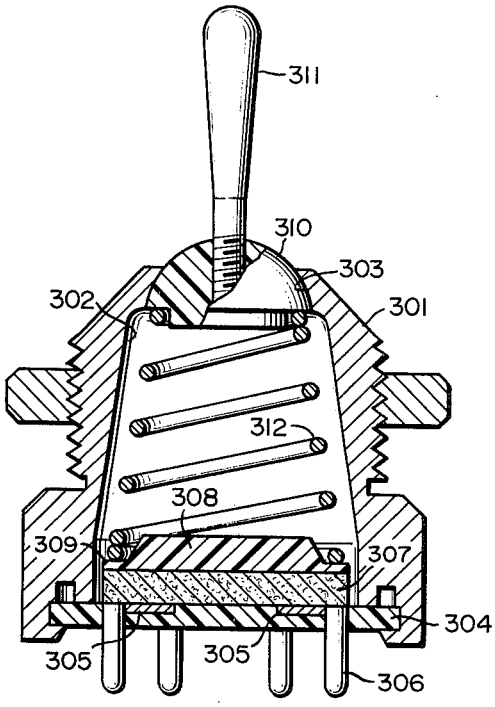
FIG. 8 is a vertical sectional, front elevational view of a third embodiment of the present invention in the off position.
Figure 9:
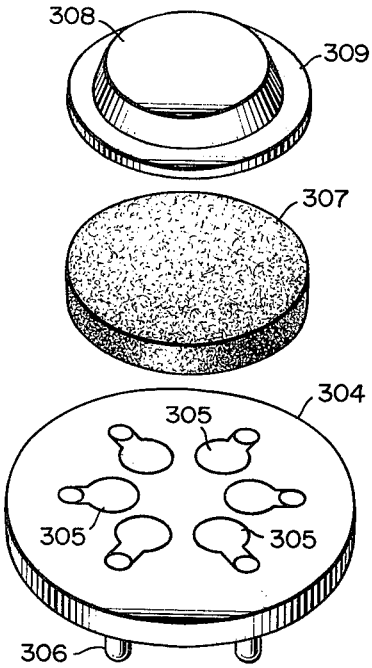
FIG. 9 is a perspective view of parts of the third embodiment to show the relation among an electrode plate, a contact element and terminals.
Figure 10:
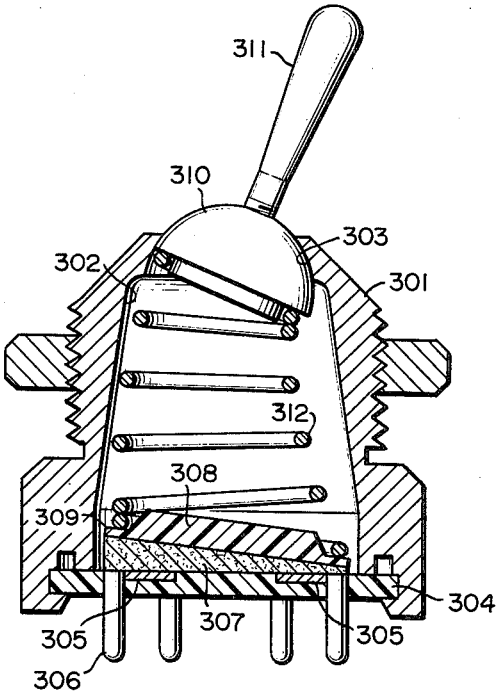
FIG. 10 is a view similar to FIG. 8 but showing the switch in the on position.

FIGS. 8, 9 and 10 show a third embodiment of the present invention. Referring to FIGS. 8 to 10, a switch casing 301 has an inner wall 302 which converges upwardly from the bottom in the form of a conical surface to terminate in an upper end opening 303 having a configuration of a part of a spherical surface. A holder 304 of electrical insulator is fixed to the bottom of the switch casing 301 in such a relation that the center thereof registers with the vertical centerline of the inner wall 302 of the switch casing 301. A plurality of electrodes 305 are fixed on the insulating holder 304 in equally circumferentially spaced relation on a circle drawn around the center of the insulating holder 304. A plurality of terminals 306 are connected to the respective electrodes 305 and protrude from the lower surface of the insulating holder 304. A circular contact element 307 of conductive elastomeric material is superposed on the insulating holder 304 to engage the electrodes 305, and a circular electrode plate 308 is superposed on the contact element 307. The electrode plate 308 is provided with a peripheral flange 309 which is engaged by one end of a coil spring 312. A substantially semispherical swinging member 310 is disposed within the switch casing 301 to engage the mating surface of the upper end opening 303 of the switch casing 301, and a manipulating lever 311 extends from the center of the upper part of the swinging member 310. The coil spring 312 is interposed between the flange 309 of the electrode plate 308 and the lower surface of the swinging member 310. This swinging member 310 cooperates with the coil spring 312 to constitute an actuating means.

When the manipulating lever 311 is urged in a direction registering with a line passing between any desired adjacent ones of the electrodes 305 as shown in FIG. 10, the semispherical swinging member 310 makes swinging movement in the same direction thereby causing corresponding deformation of the coil spring 312 as shown. As a result, the corresponding portion of the flange 309 of the circular electrode plate 308 is urged to cause tilting movement of the electrodes plate 308 around its center in the same direction as the direction in which the manipulating lever 311 is biased. The portion of the flange 309 corresponding to the biased direction of the manipulating lever 311 imparts a compressing force to the associated portion of the contact element 307 to render this compressed portion of the contact element 307 electrically conductive. Thus, the two electrodes 305 are electrically connected to each other by the circular electrode plate 308 and the compressed portion of the contact element 307 to turn on the switch.

In this embodiment, the semispherical swinging member 310 and switch casing 301 may be made of a conductor and the switch casing 301 may be grounded so that on-off operation may be attained between the switch casing 301 and the electrodes 305.

Figure 11:
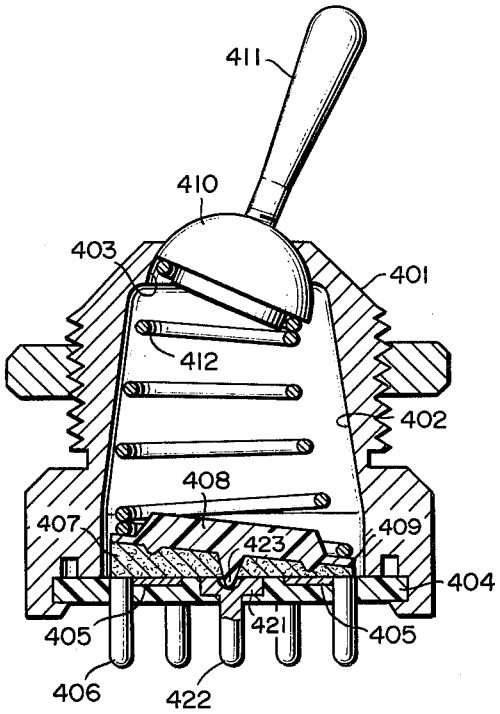
FIG. 11 is a vertical sectional, front elevational view of a fourth embodiment of the present invention in the off position.
Figure 12:
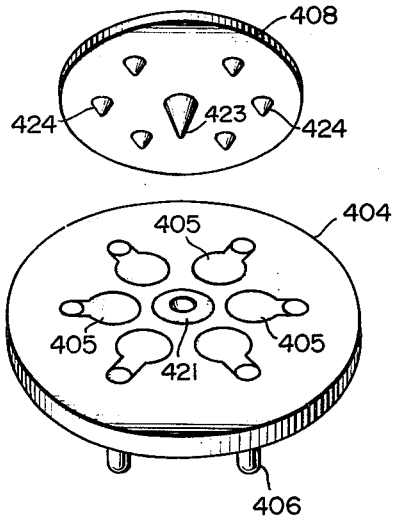
FIG. 12 is a perspective view of parts of the fourth embodiment to show the relation between an electrode plate and terminals.

FIGS. 11 and 12 show a fourth embodiment of the present invention. Referring to FIGS. 11 and 12, a plurality of electrodes 405 are arranged in equally circumferentially spaced relation on a holder of electrical insulator 404 around a central electrode 421 disposed at the center of the insulating holder 404. Terminals 406 and 422 are connected to the electrodes 405 and 421 respectively to protrude from the lower surface of the insulating holder 404. A circular electrode plate 408 is provided at the center thereof with a central projection 423 which extends through a contact element 407 of conductive elastomeric material into a hole bored in the central electrode 421 carried by the insulating holder 404. A plurality of pressure imparting projections 424 are formed on the circular electrode plate 408 at positions opposite to the respective electrodes 405. Other parts are similar to those in the third embodiment and are designated by merely adding "100" to the reference numerals of the corresponding parts in the third embodiment, and no description is given herein as to such parts.

In this fourth embodiment, the portion of the contact element 407 which is compressed to be rendered electrically conductive cooperates with the central projection 423 of the circular electrode plate 408 to establish electrical connection between the central electrode 421 and one of the electrodes 405, and the manner of operation is similar to that described with reference to the third embodiment.

Figure 13:
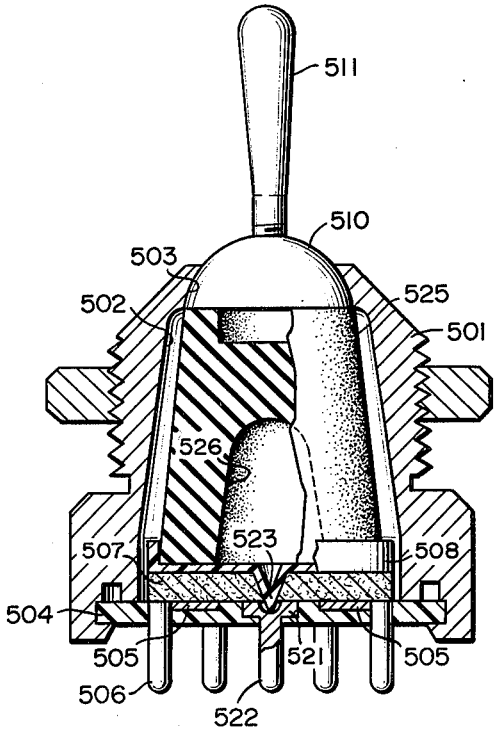
FIG. 13 is a vertical sectional, front elevational view of a fifth embodiment of the present invention in the off position.

FIG. 13 shows a fifth embodiment of the present invention which is a modification of the fourth embodiment. In this modification, the coil spring 412 shown in FIG. 11 is replaced by a frusto-conical resilient member 525 of rubber, and an upwardly extending cavity 526 is formed in the lower central portion of the member 525. Other parts are the same as those in the fourth embodiment and are designated by merely adding "100" to the reference numerals of the corresponding parts in the fourth embodiment. It is apparent that any description as to such parts is unnecessary.

Figure 14:
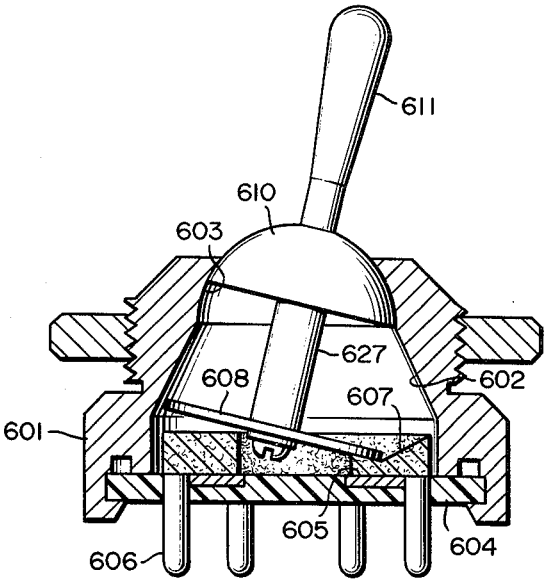
FIG. 14 is a vertical sectional, front elevational view of a sixth embodiment of the present invention in the on position.

FIG. 14 shows a sixth embodiment of the present invention which is a modification of the third embodiment. The circular contact element 307 shown in FIGS. 8 to 10 is replaced by an annular contact element 607 of conductive elastomeric material, and a circular electrode plate 608 is fixed at the center thereof to the lower end of a connecting rod 627 projecting from the center of the lower surface of a semispherical swinging member 610 to eliminate the coil spring 312 in the third embodiment. Other parts are the same as those in the third embodiment and are designated by merely adding "300" to the reference numerals of the corresponding parts in the third embodiment. It is apparent that any description as to such parts in unnecessary.

Figure 15:
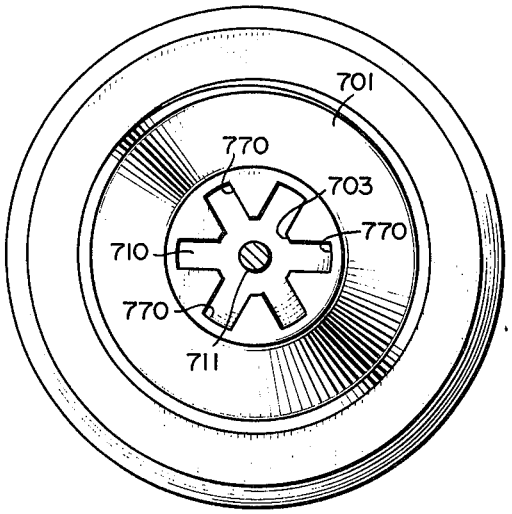
FIG. 15 is a plan view showing a slight modification of the switch casing employed in the present invention.

A switch casing 701 as shown in FIG. 15 may be used in lieu of the switch casings in the third, fourth, fifth and sixth embodiments in order that the manipulating lever can be more reliably biased in the desired direction. Referring to FIG. 15, a plurality of radially extending guide grooves 770 are formed on the peripheral edge of an upper end opening 703 of the switch casing 701, and a manipulating lever 711 is selectively engaged by any desired one of the grooves 770 so that the manipulating lever 711 can be biased in the desired direction and reliably maintained in this biased position.

I claim:

1. A switching apparatus comprising a switch casing, an insulating holder fixed to said switch casing and having a plurality of terminals fixedly disposed therein, at least one contact element of elastomeric material of the type which becomes electrically conductive upon compression and disposed to be engageable with any one of said terminals, and actuating means swingably disposed within said switch casing so as to impart a compressing force to said contact element thereby rendering said contact element electrically conductive, said actuating means including a swinging member capable of making swinging movement in a plurality of directions, said swinging member having a semi-spherical surface for engagement with an opening of mating shape provided in said switch casing.

2. A switching apparatus as claimed in claim 1, wherein said swinging member is provided with a manipulating lever, and said switch casing is provided with a plurality of guide grooves for reliably maintaining said manipulating lever in a direction in which it is biased.

3. A switching apparatus comprising a switch casing, an insulating holder fixed to said switch casing and having a plurality of terminals fixedly disposed therein, at least one contact element of elastomeric material of the type which becomes electrically conductive upon compression and disposed to be engageable with any one of said terminals, and actuating means swingably disposed within said switch casing so as to impart a compressing force to said contact element thereby rendering said contact element electrically conductive, said actuating means including a swinging member capable of making swinging movement in a plurality of directions, and an electrode plate having a flange portion which is disposed opposite to said swinging member for making electrical contact with said terminals to said contact element, a coil spring being interposed between said swinging member and said flange portion of said electrode plate.

4. A switching apparatus as claimed in claim 3, wherein said swinging member is made of a conductor, and said switch casing is also made of a conductor to serve as a terminal.

5. A switching apparatus as claimed in claim 3, wherein said electrode plate and said contact element are circular in shape, and said terminals are disposed at positions corresponding to the outer periphery of said electrode plate and said contact element.

* * * * *